US006074205A

United States Patent [19]

Myburgh

[11] Patent Number: 6,074,205

[45] Date of Patent: Jun. 13, 2000

[54] DETERMINATION OF VOLATILE MATTER IN SAMPLES

[75] Inventor: Jacobus Johannes Myburgh, Richards Bay, South Africa

[73] Assignee: South African Bureau of Standards, South Africa

[21] Appl. No.: 09/170,038

[22] Filed: Oct. 13, 1998

[30] Foreign Application Priority Data

Oct. 17, 1997 [ZA] South Africa ..... 97/9336

[51] Int. Cl.[7] ..... F27B 14/00

[52] U.S. Cl. ..... 432/156; 432/121; 432/210; 432/262; 373/118

[58] Field of Search ..... 432/210, 211, 432/156, 121, 157, 158, 159, 160, 161, 262; 266/275, 274, 200, 900, 242; 219/385–390; 373/111–119, 72, 81; 588/16

[56] References Cited

U.S. PATENT DOCUMENTS

| | | | |
|---|---|---|---|
| 936,759 | 10/1909 | Carr et al. | 432/157 |
| 1,078,408 | 11/1913 | Beattie . | |
| 1,118,820 | 11/1914 | Simpson | 432/157 |
| 1,333,629 | 3/1920 | Rahn | 432/157 |
| 1,707,294 | 4/1929 | Woodson | 432/210 |
| 1,825,556 | 9/1931 | Stevenson | 432/210 |
| 2,024,707 | 12/1935 | South, Jr. | 432/158 |
| 2,168,334 | 8/1939 | Harris | 432/210 |
| 2,175,462 | 10/1939 | Hall | 432/157 |
| 3,843,355 | 10/1974 | Reding . | |
| 4,353,535 | 10/1982 | Humberstone | 266/275 |
| 4,378,105 | 3/1983 | Zeug | 266/252 |
| 5,298,196 | 3/1994 | Heung | 588/16 |
| 5,597,501 | 1/1997 | Pollock | 219/494 |

*Primary Examiner*—Denise L. Ferensic
*Assistant Examiner*—Jippy Lu
*Attorney, Agent, or Firm*—Rothwell, Figg, Ernst & Kurtz, p.c.

[57] ABSTRACT

A coal/coke sample is heated under controlled circumstances as a step in determining content of volatile matter. The sample is placed in a crucible having a lid and which is suspended by means of a crucible holder in a heating cavity of a furnace. The invention provides precisely, mechanically guiding the crucible holder and crucible into and out of the cavity to prevent inadvertent touching of the cavity wall by the crucible and thus also to prevent possible dislodging of the lid and spoiling of the sample. The crucible holder is secured to a lid of the furnace, and the furnace lid is guided along upwardly extending guide rods. Lifting and lowering of the lid may be manually. Instead, it may be hydraulically or pneumatically.

11 Claims, 3 Drawing Sheets

DETERMINATION OF VOLATILE MATTER IN SAMPLES

THIS INVENTION relates to the determination of volatile matter in samples, more particularly to the determination of volatile matter in coal or coke samples, and to a furnace used in the determination of volatile matter in samples.

Volatile matter is determined by establishing the loss in mass resulting from heating a coal or coke sample under rigidly controlled conditions. The measured mass loss, corrected for moisture as determined, establishes the volatile matter content. Volatile matter may be used to establish the rank of coals, to indicate coke yield in the carbonization process, to provide the basis for purchasing or selling coal or coke or to establish burning characteristics of the coal or coke.

In the determination of volatile matter in samples, conventionally, use has been made of a furnace which presented difficulties in the introduction and extraction of crucibles containing samples into and out of the furnace. One difficulty encountered is that of having to lower a crucible holder by hand into the furnace without touching the sides of the furnace with the crucible, lest the lid of the crucible be dislodged and the sample be ruined. Another difficulty was caused by the loose lid arrangement of the furnace which required that the furnace lid be removed with tongs before the crucible holder could be lifted out by hand, again without the crucible holder touching the sides of the furnace. The time taken to introduce and extract the crucible resulted in undue loss of heat from the furnace.

In accordance with a first aspect of this invention, there is provided a method of introducing and extracting samples contained in a crucible into and out of a furnace, the method including providing a holder for holding the crucible and precisely, mechanically, guiding the holder into and out of the furnace so as to maintain an adequate clearance space between the crucible and an internal wall surface of the furnace.

By "mechanically guiding the holder" is meant that the holder is guided in a mechanical as opposed to a manual fashion.

In one method, applying effort, which is required to lift or to control lowering of the holder, may be manual.

In another method, applying effort, which is required to lift or to control lowering of the holder, may be pneumatic or hydraulic.

A preferred method may include securing the holder to a lid of the furnace. Guiding the holder may then be effected by guiding the lid.

When raising and lowering is manual, the method may include providing the lid with a handle such as to be heat insulated from the lid, and manipulating the lid, holder and crucible via said handle.

Said mechanical guiding may be lineal, conveniently vertically lineal.

According to a second aspect of the invention, there is provided a furnace for heating a sample contained in a crucible, which furnace includes

- a furnace body defining a furnace cavity having an opening;
- a lid for opening and closing the opening;
- a crucible holder for holding the crucible containing the sample; and
- a mechanical guide arranged precisely to guide the holder, and thus also the crucible, into and out of the furnace cavity.

Said holder may be secured to the lid, said mechanical guide then being arranged to co-operate with the lid to guide the lid. Said mechanical guide may be in the form of one or more straight guide members to effect linear guiding. Said guide member may extend, or each of said guide members may extend, vertically in use.

Said holder may be secured to the lid to project downwardly from a bottom of the lid. Securing of the holder to the lid may be adjustable in respect of the position of the holder in relation to the lid thus to render the level at which the holder depends from the lid in the furnace cavity in use, adjustable.

The furnace may include a handle secured to the lid such as to be heat insulated from the lid and thus to be touchable by hand in use manually to raise and to lower the lid and the crucible holder and the crucible.

Instead, the furnace may include a pneumatic or hydraulic raising and lowering device connected to the lid to raise and to lower the lid and the crucible holder and crucible.

The furnace may include a temperature sensor, and a mounting mounting the sensor, the mounting being adjustable so as to adjust a position of the sensor within the furnace cavity.

By way of development, the furnace may be in the form of a composite furnace, said furnace body comprising a plurality of cavities and crucible holders, the lid and mechanical guide being adapted to serve all of the cavities and crucible holders.

The invention is now described by way of example with reference to the accompanying diagrammatic drawings. In the drawings FIG. 1 shows, in three-dimensional front view, a furnace in conjunction with a controller in accordance with the invention;

Figure 1:
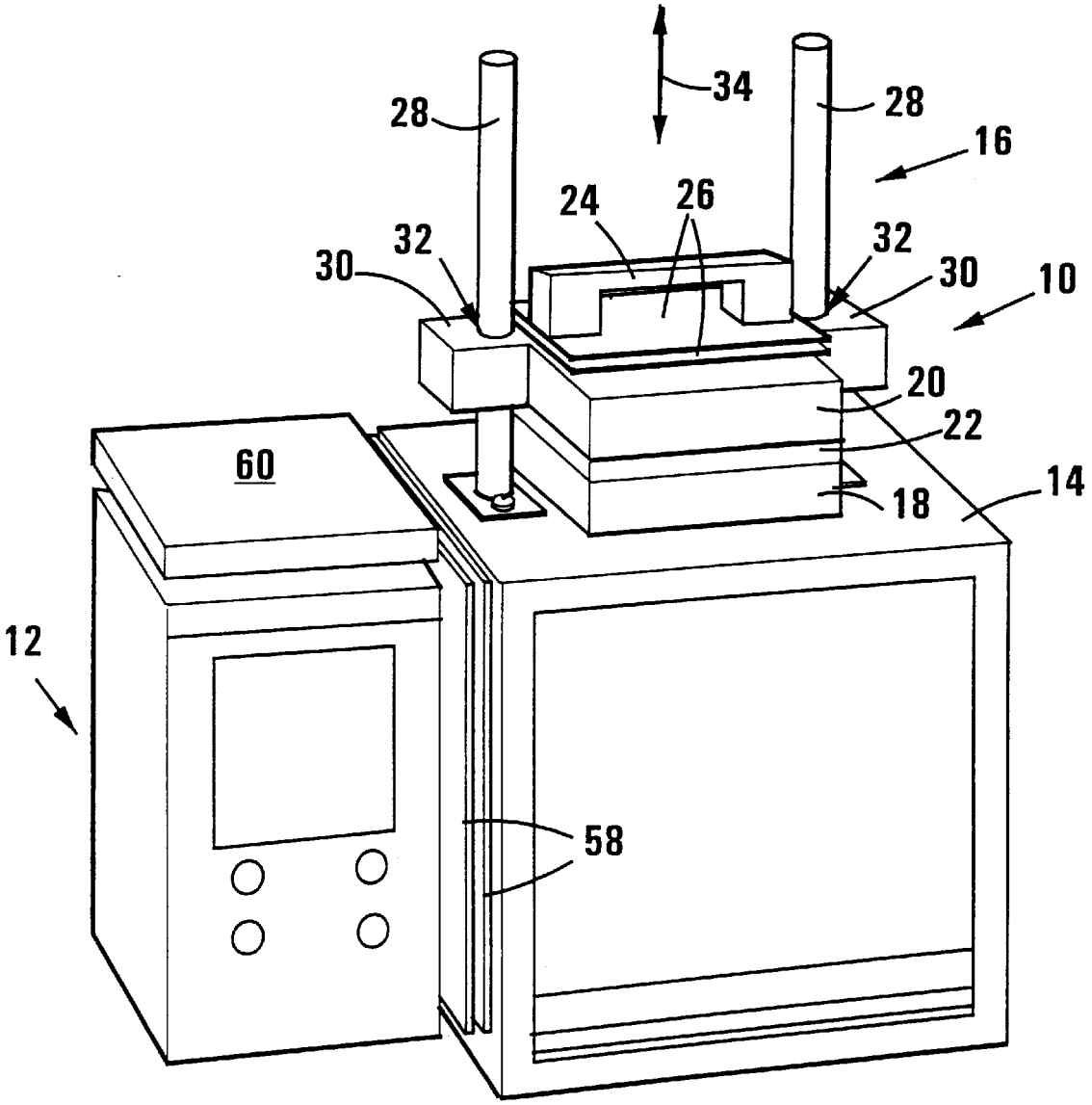
Figure 2:
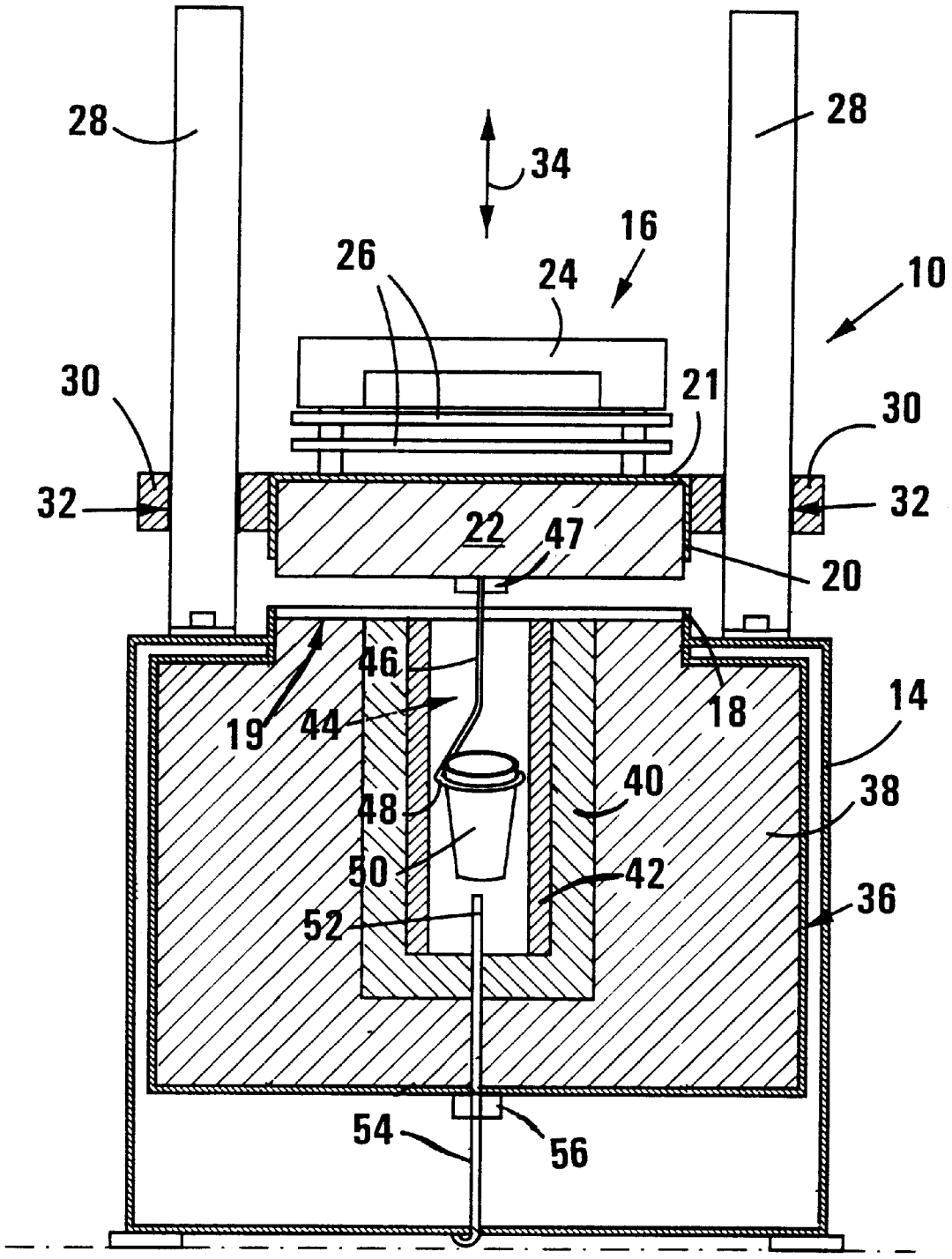
FIG. 2 shows, in sectional front view, the furnace of FIG. 1.

With reference to FIGS. 1 and 2 of the drawings, a furnace for heating coal or coke samples to determine the amount of volatile matter in the coal or coke samples, is generally indicated by reference numeral 10. The furnace 10 is used in conjunction with a controller generally indicated by reference numeral 12, arranged adjacent the furnace 10 and being suitable to regulate the temperature within the furnace 10.

The furnace 10 comprises a metal housing 14 which is of generally box-shape comprising a bottom, sides, a front and a rear as well as a top on which a lid arrangement 16 is provided.

A generally square or rectangular, open mouthed, inner casing 18 of metal is mounted within the housing 14 and the mouth thereof projects upwardly beyond the top of the housing 14. Within the housing 18, there is provided a complemental lining of fire brick 38 defining a round, cylindrical internal cavity. Concentrically within the internal cavity, there is provided a cylinder or tube of ceramic material 40. The housing 18, the insulating material 38 and the ceramic material 40 all have bottoms thus defining a round cylindrical furnace cavity generally indicated by reference numeral 44. Internally against cylindrical sides of the furnace cavity 44, there is provided a generally cylindrically shaped electrical heating element 42.

Upper surfaces of the fire brick 38, the cylinder of ceramic material 40 and the heating element 42 are truncated below the open end of the inner casing 18 to form a shallow socket as indicated by reference numeral 19.

The lid arrangement 16 comprises a metal frame 20 surrounding and mounting therein a square or rectangular lid 22 of ceramic material which projects downwardly below a lower extremity of the frame 20 to form a shallow spigot formation for snug receipt within the shallow socket 19.

A handle 24 is mounted on an upper plate 21 secured to the frame 20 and covering the ceramic lid 22. Shield plates 26 are provided spatially, in parallel, intermediate the upper plate 21 and the handle 24 to provide ventilated heat insulation for the handle 24.

The housing 14 mounts a pair of parallel, upwardly directed guide rods 28 at either side of the inner casing 18. The frame 20 of the lid arrangement 16 mounts laterally projecting bush formations 30 each having a bore 32, the bores 32 being complemental in respect of shape, size and spacing to the shape and size and spacing of the rods 28 to be slidably received over the rods 28 to guide the lid arrangement 16 upwardly and downwardly as indicated by arrows 34 respectively to open and to close the furnace cavity 44. The arrangement is such that the lid arrangement 16 is guided precisely, i.e. with virtually no lateral clearance or lost motion.

At the bottom of the lid arrangement 16, a crucible holder 46 extends downwardly and includes at its bottom a loop 48 within which a crucible 50 can be supported, nest fashion. In use, the sample to be tested will be contained within the crucible 50.

To regulate the temperature in the furnace cavity 44, a sensor 52 is provided extending upwardly from a bottom of the furnace cavity to a position immediately underneath a bottom of the crucible 50 when the lid 16 is fully seated. Conductors 54 extend from the sensor 52 to the controller 12. The controller 12 then controls the heat within the furnace cavity to within a predetermined temperature range.

By way of development, the degree to which the crucible holder 46 extends downwardly from the lid can be adjusted by having an upper end of the crucible holder screwed into a screw formation associated with the lid arrangement 16. Advantageously, a locking arrangement, for example in the form of a lock nut 47, may be provided to lock the crucible holder at a desired adjustment.

Correspondingly, advantageously, the extent to which the sensor 52 extends into the furnace cavity can be adjusted to ensure that the temperature immediately underneath the crucible is measured. The sensor can be clamped in a desired attitude, by means of a clamp 56 which is shown schematically only. Thus, in use, the crucible holder will be adjusted such that the crucible 50 is supported more or less in the centre of the furnace cavity 44 i.e. in the hottest part or hot zone of the furnace cavity 44, and the sensor will be adjusted to measure the temperature immediately underneath the crucible.

Advantageously, spaced heat shields 58 are provided intermediate the housing 14 of the furnace 10 and the controller 12 to provide ventilated heat insulation for the controller 12. Furthermore, a heat resistant work top 60 is provided over the controller 12 to support hot crucibles. A spaced heat shield may be provided intermediate the top 60 and the top of the controller 12.

In use, when a sample is to be tested, the projections of the crucible holder and the sensor 52 are adjusted as described above.

While the lid arrangement 16 is elevated one handedly by an operator by means of the handle 24 along the guide rods 28, the crucible 50 containing a sample of coal or coke is supported within the crucible holder 46. The crucible 50 is covered by means of a disc in the form of a lid closing its opening.

The lid arrangement 16 and the crucible holder 46 and crucible 50 therewith can now be lowered into the furnace cavity 44 by allowing the lid arrangement 16 to slide along the guide rods 28. It is to be appreciated that no lateral displacement or rocking is allowed and that the motion of the crucible is pure translation in a vertical direction such that clearance is provided between the holder 46 and crucible 50 on the one hand and inner walls of the furnace cavity 44 on the other hand.

The sample within the crucible 50 is heated as required by the testing standard applicable. After heating, the lid arrangement 16 and with it the crucible holder 46 and crucible 50 can be lifted one handedly via the handle 24. Again, lifting is guided to be purely vertical translation and such that the crucible holder 46 and crucible 50 do not touch sides of the furnace cavity 44. When the crucible 50 has been lifted clear of the furnace cavity 44, it can be removed from the crucible holder for determination of its mass.

A number of important advantages is provided by the invention.

The most important advantage is that insertion and extraction of the crucible into and out of the furnace cavity are mechanically precisely guided such that touching of the holder or crucible against sides of the furnace cavity is prevented thus ensuring that the lid on the crucible is kept intact. Conventionally, the crucible holder or crucible could be, and frequently were, bumped against the furnace wall, thus displacing the lid, letting in air and thus causing the sample to ignite. The test then had to be repeated. It is further to be appreciated that such guiding in accordance with the invention allows insertion (loading) and extraction (unloading) to be done with great integrity such that spoiling of samples is eliminated or virtually eliminated.

Furthermore, such insertion and extraction can be effected quickly thus rendering the device in accordance with the invention user-friendly in addition to saving operator and equipment time and generally enhancing productivity of testing.

Yet further the furnace cavity is left open for short periods of time only thus conserving energy and furthermore limiting cooling down of the furnace cavity in between testing different samples thus enhancing the quality of testing.

It is yet a further advantage that the effective length of the crucible holder is adjustable to ensure that the crucible is generally in the centre of the heat zone of the furnace cavity. In addition to this, the position at which the temperature is sensed is appropriately adjusted by adjusting the extent of projection of the sensor within the furnace cavity.

Figure 3:
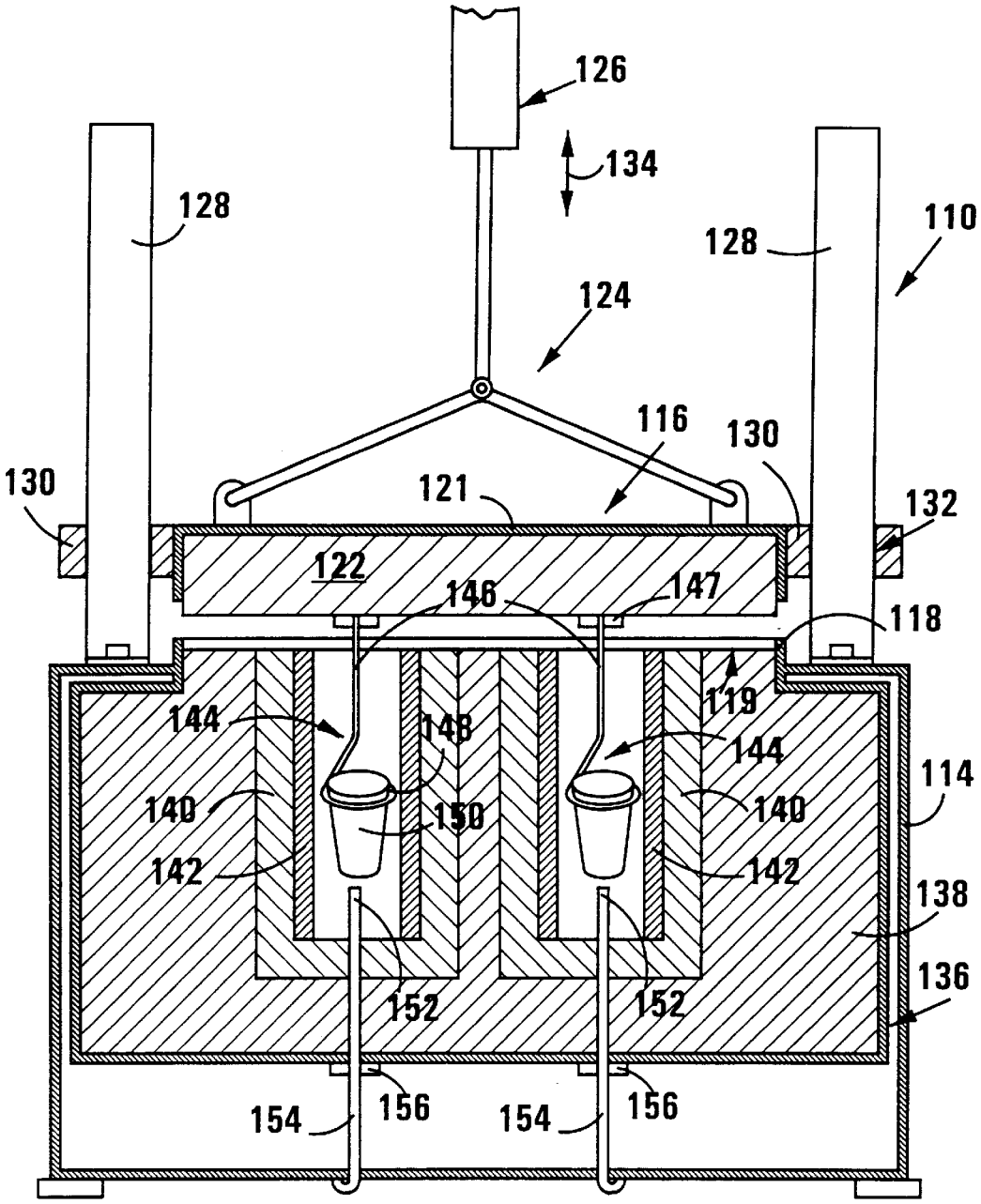
FIG. 3 shows, schematically, in sectional front view, another embodiment of the furnace.

By way of development, with reference to FIG. 3, another embodiment of a furnace for heating coal or coke samples to determine the amount of volatile matter in a coal or coke sample, is generally indicated by reference numeral 110. The furnace 110 is similar in many respects to the furnace 10 of FIGS. 1 and 2, and generally, like reference numerals are used to demote like features or components. Thus, the furnace 110 is not again described and emphases will merely be placed on two important developments.

First, the furnace 110 has a plurality of furnace cavities within which a corresponding plurality of samples can be heated simultaneously. In the embodiment shown, four cavities, of which two can be seen in FIG. 3, are provided. Behind the two cavities shown, another two cavities are provided. Naturally, if desired, more of fewer cavities than the number of four mentioned above can be provided if desired.

Secondly, the lid arrangement 116 is rased and lowered pneumatically or hydraulically by means of one or more plunger or cylinder arrangement, one of which is shown by reference numeral 126. A shank of the plunger is shown to be connected via slings to apertured lugs secured to the frame 121 of the lid arrangement 116. It is to be appreciated the plunger and cylinder arrangement 126 and connection thereof to the lid, generally indicated by reference numeral 124, are rudimentary in design, intended as illustrative only for purposes of this specification and, if desired, more sophisticated arrangements can easily be provided and which would still fall within the scope of this invention.

The embodiment of FIG. 3 generally has the same advantages as described for the embodiment of FIGS. 1 and 2. In addition it has the advantage of being able to heat a plurality of samples simultaneously, and furthermore that the lid arrangement which can be heavy because the furnace will be larger, can be raised and lowered hydraulically or pneumatically.

What is claimed is:

1. A method of introducing and extracting a sample contained in a crucible into and out of a furnace having a furnace cavity, the method including providing a holder for holding the crucible and precisely, mechanically, guiding the holder from a position clear of the furnace cavity into the furnace cavity to a located position within the furnace cavity in which the holder is located, and from said located position within the furnace cavity out of the furnace cavity to a position clear of the furnace cavity so as to maintain an adequate clearance space between the crucible and an internal wall surface of the furnace while the holder holding the crucible moves between said position clear of the furnace cavity and said located position within the furnace cavity.

2. A method as claimed in claim 1 in which said mechanical guiding is lineal along at least one straight guide extending from an upper face of the furnace.

3. A method as claimed in claim 1 in which the furnace includes a lid for covering said furnace cavity, a handle mounted on the lid such as to be heat insulated from the lid, and at least one mechanical guide projecting from an upper surface of the furnace, the lid being slidable along said at least one mechanical guide, and in which the holder is secured to the lid, the method including raising and lowering the lid, and with the lid the holder and the crucible, via said handle along said at least one mechanical guide.

4. A method as claimed in claim 1 in which the furnace includes a lid for covering said furnace cavity, hydraulic or pneumatic lifting and lowering apparatus connected to the lid, and at least one mechanical guide projecting from an upper surface of the furnace, the lid being slidable along said at least one mechanical guide, and in which the holder is secured to the lid, the method including raising and lowering the lid, and with the lid the holder and the crucible, hydraulically or pneumatically, along said at least one mechanical guide.

5. A furnace for heating a sample contained in a crucible, which furnace includes a furnace body defining a furnace cavity having an opening;

a lid for opening and closing the opening;

a crucible holder for holding the crucible containing the sample; and a mechanical guide arranged precisely to guide the holder, and thus also the crucible, from a position clear of the furnace cavity into the furnace cavity to a located position within the furnace cavity in which the holder is located, and from said located position within the furnace cavity out of the furnace cavity to a position clear of the furnace cavity so as to maintain an adequate clearance space between the crucible and an internal wall surface of the furnace while the holder holding the crucible moves between said position clear of the furnace cavity and said located position within the furnace cavity.

6. A furnace as claimed in claim 5 in which said holder is secured to the lid, and in which said lid is slidable along said mechanical guide.

7. A furnace as claimed in claim 6 in which said mechanical guide is in the form of one or more straight guide members to effect linear guiding, the guide members extending vertically from an upper surface of the furnace.

8. A furnace as claimed in claim 6 in which said holder is secured to the lid to project downwardly from a bottom of the lid.

9. A furnace as claimed in claim 6 in which securing of the holder to the lid is such that the holder projects downwardly from a bottom of the lid and is adjustable in respect of the position of the holder in relation to the lid thus to render the level at which the holder depends from the lid in the furnace cavity in use, adjustable.

10. A furnace as claimed in claim 5 which includes a temperature sensor, and a mounting mounting the sensor, the mounting being adjustable so as to adjust a position of the sensor within the furnace cavity.

11. A furnace as claimed in claim 5 which is in the form of a composite furnace, said furnace body comprising a plurality of furnace cavities, said furnace comprising a plurality of crucible holders, and a lid which is common to all of the furnace cavities, the crucible holders being secured to the lid to depend from a bottom of the lid at predetermined positions to be in register with the respective furnace cavities, the lid being slidable along said mechanical guide to guide all of the crucible holders simultaneously.

* * * * *